US010866062B1

(12) United States Patent
Derousse

(10) Patent No.: US 10,866,062 B1
(45) Date of Patent: Dec. 15, 2020

(54) VERTICAL FORWARD GRIP

(71) Applicant: Damon William Derousse, Red Bud, IL (US)

(72) Inventor: Damon William Derousse, Red Bud, IL (US)

( * ) Notice: Subject to any disclaimer, the term of this patent is extended or adjusted under 35 U.S.C. 154(b) by 0 days.

(21) Appl. No.: 16/602,595

(22) Filed: Nov. 6, 2019

Related U.S. Application Data

(60) Provisional application No. 62/922,532, filed on Aug. 14, 2019.

(51) Int. Cl.
*F41C 23/16* (2006.01)
*F41C 27/00* (2006.01)

(52) U.S. Cl.
CPC ..... *F41C 23/16* (2013.01); *F41C 27/00* (2013.01)

(58) Field of Classification Search
CPC ..... F41C 23/16
USPC ..... 42/72
See application file for complete search history.

(56) References Cited

U.S. PATENT DOCUMENTS 8,839,544 B2 * 9/2014 Troy ..... F41C 23/16 42/72
2016/0245616 A1 * 8/2016 Derousse ..... F41C 23/16

* cited by examiner

*Primary Examiner* — Reginald S Tillman, Jr.

(57) ABSTRACT

The vertical forward grip is a revolutionary new design, which increases shooter(s) accuracy, providing comfort to the shooter and increasing control of the weapon, while reducing fatigue to the shooter(s) overall stamina. The overall design, ergonomic feel, textured finger grip and an ergonomic index finger stabilization cradle of the vertical forward grip allows the shooter(s) to remain comfortable for long extended periods of time, increasing accuracy and control, providing stabilization of the weapon and the design features are different from conventional vertical forward grip(s). Specific design features/improvements are incorporated into the vertical forward grip unlike the design of conventional vertical forward grip(s). Design features and improvements include: a ergonomic index finger stabilization cradle, a textured finger grip, an ergonomic grip control feature (increasing grip comfort, control and accuracy), and a threaded quick turn-and-release base grip cap tube.

1 Claim, 3 Drawing Sheets

SIDE VIEW

BOTTOM VIEW

TOP VIEW

SIDE VIEW

SIDE VIEW

BOTTOM VIEW

FRONT VIEW

VERTICAL FORWARD GRIP

CROSS REFERENCE TO RELATED APPLICATIONS

This application claims the benefit of U.S. Provisional Patent Application No. 62/973,386, filed 2 Oct. 2019.

(Vertical Forward Grip) Field of classification search (42/72; 42/94), International classification (F41A 35/06; F41C 23/12; F41C 23/14; F41C 23/22; F41C 27/00), U.S. classification CPC (42/94; 42/73; F41C 27/00; F41C 27/22; F41C 23/22) and U.S. classification USPC (42/72; 362/110).

STATEMENT REGARDING FEDERALLY SPONSORED RESEARCH OR DEVELOPMENT

Not Applicable.

NAMES OF THE PARTIES TO A JOINT RESEARCH AGREEMENT IF THE CLAIMED INVENTION WAS MADE AS A RESULT OF ACTIVITIES WITHIN THE SCOPE OF A JOINT RESEARCH AGREEMENT

Not Applicable.

REFERENCE TO A "SEQUENCE LISTING," A TABLE, OR A COMPUTER PROGRAM LISTING APPENDIX SUBMITTED ON A COMPACT DISC AND AN INCORPORATION BY REFERENCE OF THE MATERIAL ON THE COMPACT DISC. THE TOTAL NUMBER OF COMPACT DISC INCLUDING DUPLICATES AND THE FILES ON EACH COMPACT DISC SHALL BE SPECIFIED

Not Applicable.

BACKGROUND OF THE INVENTION

A vertical forward grip may consist of a device attached to a Picatinny, Weaver or similar mounting rail integration system of a short barreled rifle, long barreled rifle, shotgun or related type of firearm. The upper portion of the vertical forward grip may be quickly detached or locked into permanent position via locking mechanism. The vertical forward grip can be adjusted on the rail of the firearm platform to assist with the operator(s) necessities. The vertical forward grip is comprised of an ergonomic configuration suited to the purposes of the operator(s) natural grip and control.

Conventional vertical forward grip(s) provide a less desired grip, creating fatigue on the shooter(s), reducing the shooter(s) accuracy. Conventional vertical forward grips do not stabilize the firearm as well, providing moderate comfort and control. Conventional vertical forward grips do not give the desired control and comfort to the shooter, fatiguing the shooter over long extended periods of use.

Presently there is no solution with a conventional vertical forward grip(s) to increase stability, accuracy, control and comfort of a firearm.

Therefore, it is the design of this current invention that provides a new and improved vertical forward grip for mounting on firearms.

It is another design improvement of this current invention to provide a new and improved vertical forward grip with the implementation of the ergonomic forward finger stabilization cradle.

It is another design improvement of this current invention to provide a new and improved vertical forward grip with the implementation of the improved textured grip placement.

It is another design improvement of this current invention to provide a new and improved vertical forward grip with the implementation of the improved integrated threaded quick turn-and-release base grip cap, via quick mounting and removal of the vertical forward grip.

It is another design improvement of this current invention to provide a new and improved vertical forward grip with the implementation of the improved integrated threaded quick turn-and-release base grip cap, via adjustment of the vertical forward grip along the longitudal axis of the of the rail integration system.

BRIEF SUMMARY OF THE INVENTION

In brief, to attain the preferred design improvement of the invention in accordance with the preferred embodiment thereof, a vertical forward grip is disclosed. The present invention seeks to provide a solution to this problem by providing a more ergonomic feel to the shooter while giving additional stability to the weapon improving accuracy/control/comfort to the shooter, with the implementation of the improved texture grip placement and ergonomic index finger stabilization cradle.

BRIEF DESCRIPTION OF THE SEVERAL VIEWS OF THE DRAWING

The following changes and specific design improvements of this current invention will become starkly apparent from the following detailed description of the invention, when taken into consideration with the drawings, in which.

DETAILED DESCRIPTION OF THE INVENTION

Figure 1:
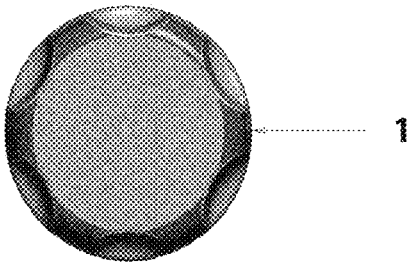
FIG. 1 is a bottom view of the improved integrated threaded quick turn-and-release base grip cap.
Figure 2:
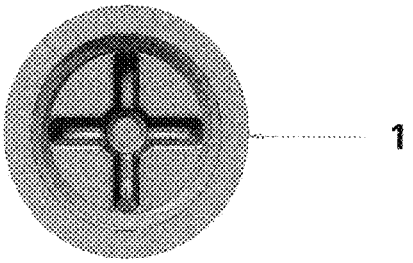
FIG. 2 is a top view of the improved integrated threaded quick turn-and-release base grip cap.
Figure 3:
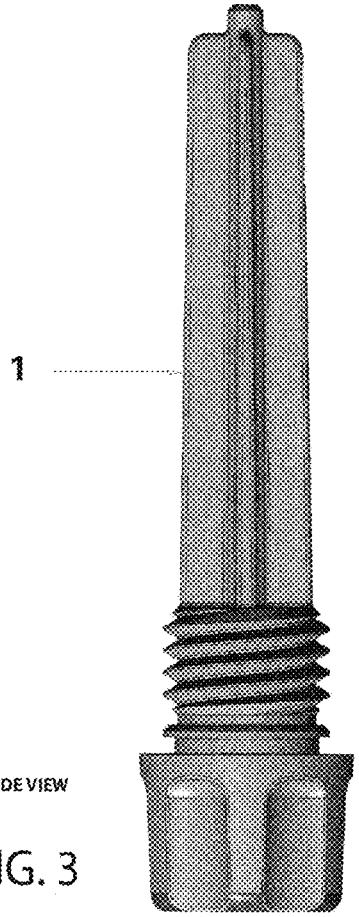
FIG. 3 is a side view of the improved integrated threaded quick turn-and-release base grip cap.
Figure 4:
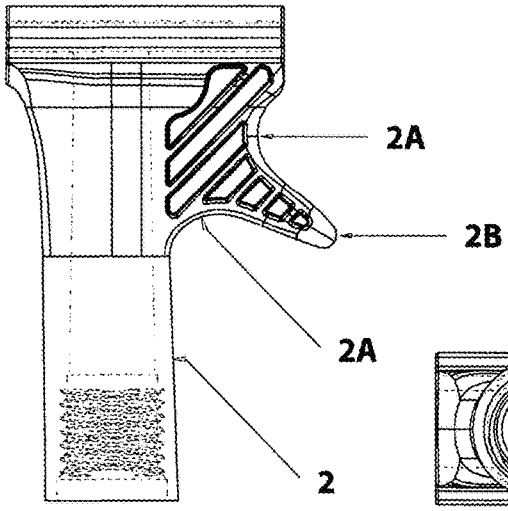
FIG. 4 is a side view of the vertical forward grip.
Figure 5:
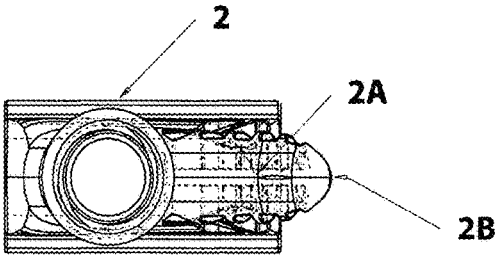
FIG. 5 is a bottom view of the vertical forward grip.
Figure 6:
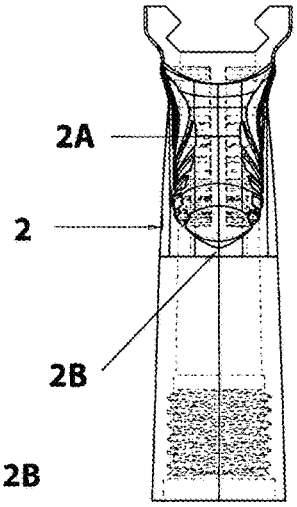
FIG. 6 is a front view of the vertical forward grip.
Figure 7:
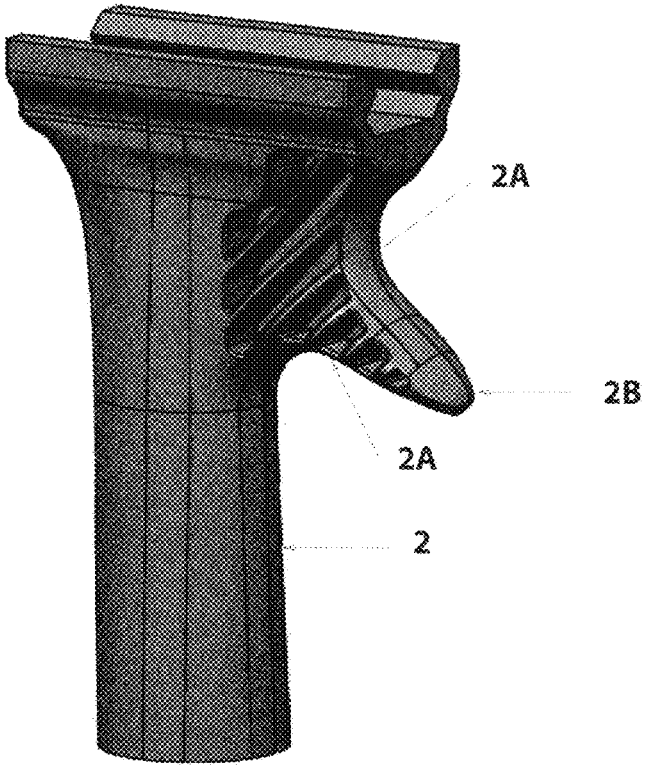
FIG. 7 is a embossed side view of the vertical forward grip.
Figure 8:
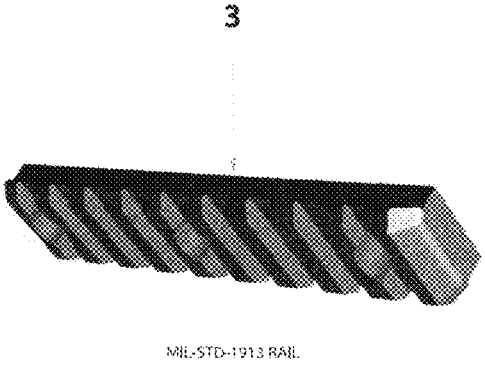
FIG. 8 is a bottom view of a rail integration system (standard picatinny rail).

Turning to FIG. 4, a vertical forward grip in accordance with the current invention, is illustrated. Vertical forward grip 2 includes an improved textured finger grip placement 2A and ergonomic index finger stabilization cradle 2B. Integrated with the vertical forward grip 2 includes a lower sealing threaded quick turn-and-release base grip cap 1, allowing for quick removal and adjustment/positioning on the lower portion of the rail integration system 3. Illustrated in FIGS. 4, 5, 6 and 7, the ergonomic configuration is suited to the purposes of the operator(s) natural grip and control per textured finger grip 2A and an ergonomic index finger stabilization cradle 2B.

Referring additionally to FIGS. 4, 5, 6 and 7, a vertical forward grip in accordance with the current invention, is illustrated. Vertical forward grip 2 includes a threaded quick turn-and-release base grip cap 1. This threaded turning advances threaded quick turn-and-release base grip cap 1 inside of the vertical forward grip 2 in the direction toward the opening of the rail integration system 3. Ultimately, the top end of the threaded quick turn-and-release base grip cap 1 abuts the lower portion of the rail integration system 3. Consequently, when the upper portion of the threaded quick turn-and-release base grip cap 1 is pushed upwardly. Ultimately, this threaded quick turn-and-release base grip cap 1 extends into the opening the vertical forward grip 2 locking the entire assembly with regard to the rail integration system 3.

When the threaded quick turn-and-release base grip cap 1, is rotated in the opposite direction, biased extension of the threaded quick turn-and-release base grip cap 1, moves downwardly permitting the retention in its lower most position. The rotation of the threaded quick turn-and-release base grip cap 1, provides adjustable pressure between the vertical forward grip 2, and the rail integration system 3, providing adjustability or removal of the vertical forward grip 2 along the axis of the rail integration system 3.

In the assembly and operation or positioning of the vertical forward grip 2 and its components 1-2, Illustrated in FIG. 1-8, components 1 and 2 interlock with components 1 and 2, securing the upper portion of 2 to a rail integration system 3 via removability, positioning, attachment and adjustment along the recessed slots of the lower rail integration system 3. Thus the vertical forward grip 2 has a stable platform when secured into place by rotating the quick turn-and-release integrated base grip cap 1, which in turn engages into the recessed slots of the lower portion of a rail integration system 3. The vertical forward grips components 1-2 can be quickly adjusted on the rail integration system 3 of the firearm platform to assist with the operator(s) necessities. The vertical forward grip 2 is comprised of a textured finger grip 2A and an ergonomic index finger stabilization cradle 2B providing optimal grip placement in regard to the operator(s) natural grip, comfort and control, reducing fatigue on the operator and increasing the shooters accuracy and stabilization of the weapon.

Therefore, a new and improved vertical forward grip design is shown and described. The new and improved vertical forward grip is designed to provide a solution to this problem by providing a more ergonomic feel to the shooter while giving additional stability of a firearm and accuracy/control/comfort to the shooter, with the implementation of the improved textured finger grip and ergonomic index finger stabilization cradle.

This vertical forward grip is a revolutionary new design, which increases shooter(s) accuracy, providing comfort to the shooter and increasing control of the weapon, while reducing fatigue to the shooter(s) overall stamina. The overall design, ergonomic feel, textured finger grip placement and the ergonomic index finger stabilization cradle of the vertical forward grip allows the shooter(s) to remain comfortable for long periods, increasing accuracy and control, and new design features are different from conventional vertical forward grip(s). Specific design features/improvements are incorporated into the vertical forward grip unlike the design of conventional vertical forward grip(s). Design features and improvements include: a ergonomic index finger stabilization cradle, a textured finger grip, a ergonomic grip control feature (increased grip control and accuracy) and a threaded quick turn-and-release base grip cap tube.

Various changes, improvements and modifications to the vertical forward grip, will be clearly recognized in the illustrations. Such modifications and specific design improvements of this current invention, along with a detailed description, are intended and included within the scope which is assessed only by a fair interpretation of the following claims.

Having fully described the improvements, along with a detailed description, in a clear and concise manner, to help assist with the understanding of the invention claimed.

SEQUENCE LISTING (IF ANY)

Not Applicable.

The invention claimed is:

1. A firearm forward grip mounting device comprising:

a) a top part having a dovetail shaped slot configured to mount to a picatinny rail;

b) a grip tube extending from the top part and having a textured, forward extending finger cradle; wherein the grip tube has internal locking threads at the bottom of the tube; and c) a grip tube cap having a cap on the bottom end of the grip tube cap, external threads adjacent the cap for mating with the internal threads of the grip tube; and a top section, the cross-section of the top section having four blades extending away from a circular middle section, wherein the blades extend the length of the top section.

* * * * *